US010702074B2

(12) United States Patent
Najafi et al.

(10) Patent No.: US 10,702,074 B2
(45) Date of Patent: Jul. 7, 2020

(54) BABY SEAT CARRIER

(71) Applicant: NAJELL AB, Lund (SE)

(72) Inventors: Niklas Najafi, Lund (SE); Freja Ljungdell Kristensen, Lund (SE)

(73) Assignee: Najell AB, Lund (SE)

( * ) Notice: Subject to any disclaimer, the term of this patent is extended or adjusted under 35 U.S.C. 154(b) by 16 days.

(21) Appl. No.: 16/301,770

(22) PCT Filed: Jan. 20, 2017

(86) PCT No.: PCT/SE2017/050057
§ 371 (c)(1),
(2) Date: Nov. 15, 2018

(87) PCT Pub. No.: WO2017/200451
PCT Pub. Date: Nov. 23, 2017

(65) Prior Publication Data

US 2019/0150634 A1 May 23, 2019

(30) Foreign Application Priority Data

May 20, 2016 (SE) ..... 1650694

(51) Int. Cl.
*A47D 13/02* (2006.01)
*A47D 13/08* (2006.01)
*A47D 15/00* (2006.01)

(52) U.S. Cl.
CPC ..... *A47D 13/025* (2013.01); *A47D 13/08* (2013.01); *A47D 15/006* (2013.01)

(58) Field of Classification Search
CPC ..... A47D 13/02; A47D 13/025; A45F 3/04; A45F 2003/144
See application file for complete search history.

(56) References Cited

U.S. PATENT DOCUMENTS 4,009,808 A * 3/1977 Sharp ..... A47D 13/025 224/160
4,901,898 A * 2/1990 Colombo ..... A47D 13/025 224/159

(Continued)

FOREIGN PATENT DOCUMENTS

CN 104042068 A 9/2014
CN 204260362 U 4/2015

(Continued)

OTHER PUBLICATIONS

International Search Report dated May 22, 2017 issued in International Application No. PCT/SE2017/050057.

(Continued)

*Primary Examiner* — Brian D Nash
(74) *Attorney, Agent, or Firm* — Renner, Otto, Boisselle & Sklar, LLP

(57) ABSTRACT

The present invention relates to a baby seat carrier comprising shoulder strap members, a waist belt member, a stool seat member connected to the waist belt member, an internal fabric member configured to abut and extend along the torso of a carrying user and that is connected to the waist belt member and the shoulder strap members, an external cover member extending along a longitudinal direction (L) of the internal fabric member, the external cover member having a lower portion that is detachably connected to the internal fabric member such that the external cover member and the internal fabric member form a suspended pocket seat.

18 Claims, 12 Drawing Sheets

(56) References Cited

U.S. PATENT DOCUMENTS

| | | | | |
|---|---|---|---|---|
| 5,205,450 | A * | 4/1993 | Derosier | A47D 13/025 224/161 |
| 5,224,637 | A * | 7/1993 | Colombo | A47D 13/025 224/158 |
| 5,492,256 | A * | 2/1996 | Ive | A47D 13/025 220/528 |
| 6,098,857 | A * | 8/2000 | Le Gal | A47D 13/025 224/153 |
| 6,715,651 | B2 * | 4/2004 | Le Gal | A47D 13/025 224/160 |
| 8,172,116 | B1 * | 5/2012 | Lehan | A45F 3/04 224/160 |
| 8,627,988 | B2 | 1/2014 | Bergkvist | |
| 8,752,739 | B2 * | 6/2014 | Bergkvist | A47D 13/025 224/158 |
| 9,314,112 | B2 * | 4/2016 | Chuah | A47D 13/025 |
| 9,357,852 | B2 * | 6/2016 | Salazar | A47D 13/025 |
| 9,439,515 | B2 * | 9/2016 | Kim | A45F 3/04 |
| 9,596,947 | B2 * | 3/2017 | Lee | A47D 13/025 |
| 10,172,477 | B2 * | 1/2019 | Flaunty | A47D 13/025 |
| D849,397 | S * | 5/2019 | Tsai | D3/214 |
| 10,349,754 | B2 * | 7/2019 | Kang | A47D 13/025 |
| 10,426,275 | B2 * | 10/2019 | Telford | A47D 13/025 |
| 10,441,091 | B2 * | 10/2019 | Salazar | A47D 13/025 |
| 2007/0029356 | A1 * | 2/2007 | Moriguchi | A47D 13/02 224/160 |
| 2007/0246493 | A1 * | 10/2007 | Kernkamp | A45F 3/14 224/159 |
| 2009/0206116 | A1 * | 8/2009 | Grant | A45F 3/08 224/160 |
| 2010/0072236 | A1 * | 3/2010 | Parness | A47D 13/02 224/161 |
| 2011/0290831 | A1 * | 12/2011 | Wang | A47D 13/025 224/160 |
| 2014/0231472 | A1 * | 8/2014 | Cha | A47D 13/025 224/160 |
| 2015/0196133 | A1 * | 7/2015 | Rosen | A47D 13/025 224/160 |

FOREIGN PATENT DOCUMENTS

| | | |
|---|---|---|
| CN | 204617687 U | 9/2015 |
| WO | 2015/053696 | 4/2015 |

OTHER PUBLICATIONS

Written Opinion dated May 22, 2017 issued in International Application No. PCT/SE2017/050057.

* cited by examiner

BABY SEAT CARRIER

RELATED APPLICATIONS

This application is a national phase entry of International Application No. PCT/SE2017/050057 filed on Jan. 20, 2017 and published in the English language, which claims priority to Swedish Application No. 1650694-1, filed May 20, 2016, both of which are hereby incorporated by reference.

The present invention relates to a baby seat carrier which facilitates at least two seating positions. In particular the present invention relates to a baby seat carrier which may be configured to provide at least two seat positions; a first suspended open pocket seat and a second firm stool seat. More in particular the baby seat carrier according to aspects present invention features an internal plate/fabric member and an external cover member detachably connected to the internal fabric member or to the stool seat member.

BACKGROUND OF THE INVENTION

The typical prior art infant seat meticulously strive to embody the ambition to provide safety and comfort to an infant while being carried by its guardian. One example of prior art infant seat is provided by U.S. Pat. No. 8,627,988 disclosing what is referred to as a baby seat comprising a type of pocket seat. The baby seat according to the disclosure is intended for children up to an alleged 12 kg, typically corresponding to an age of 3 years. However, during the life time up to the said age, not only the weight of the baby begins to differ significantly, also the skeleton of the baby undergo significant changes; a baby spine for example, is relatively soft and is commonly said to comprise the characteristic C-shape of a baby when in fetal/frog position. Approximately between the ages of 4-6 months the baby not only gain in weight but its spine also undergo changes in that it attains the characteristic S-shaped spine. The above evolvements thus render the seating position of the typical prior art baby seat carrier moot as they typically do not provide an adequate seating position for a baby having developed the S-shaped spine, nor does it provide adequate means for distribution of the alleged weight to the person carrying the baby seat carrier. Furthermore, the S-shaped spine places demands not only on the resulting arrangement of the spine of the baby while sitting in the baby seat carrier, it also places demands on the actual load-carrying seat of the baby seat carrier to distribute the increased weight not exclusively to the shoulders of the user carrying the seat solution. For the above mentioned reasons, the typical baby seat carrier suitable for babies above approximately 6 months does not feature the above mentioned pocket-like seat, but instead they provide a seating position of the child which reminds more of the seating position of an adult and which seating position may be referred to as a stool seat.

SUMMARY OF THE INVENTION

On this background, it is an object of the present invention to provide a baby seat carrier which facilitates proper seating positions for infants ranging from newborn to approximately 3 years or 15 kg. It is a further object of the present invention to provide a baby seat carrier which provides adequate weight distribution on the user being equipped with the baby seat carrier. It is a yet further object of the present invention to provide a baby seat carrier which is easy to use.

Objects of the invention are achieved by providing a baby seat carrier comprising shoulder strap members, a waist belt member, a stool seat member connected to the waist belt member, an internal fabric member configured to abut and extend along the torso of a carrying user and that is connected to the waist belt member and the shoulder strap members, an external cover member extending along a longitudinal direction of the internal fabric member, the external cover member having a lower portion that is detachably connected to the internal fabric member such that the external cover member and the internal fabric member form a suspended pocket seat.

Objects of the invention are further achieved by the lower portion of the external cover member is further adapted to be detachably connected to the stool seat member such that the stool seat member and the external cover member form a stool seat.

According to one aspect the suspended pocket seat and the stool seat member are arranged at a longitudinal distance from each other.

According to one aspect, the stool seat member comprises an outer ridge and the lower portion of said external cover member is detachably connected to the outer ridge such that said external cover member extend in parallel with the internal fabric member such as to provide a back/spine support associated with the stool seat member.

According to an aspect the baby seat carrier further comprise an extension member that at a first end is arranged to be detachably connected to the internal fabric member and at a second end is arranged to be detachably connected to the lower portion of said external cover member, such that the internal fabric member, the extension member and the external cover member form an extended suspended pocket seat.

According to an aspect the first end of the extension member is fixedly connected to the internal fabric member.

According to an aspect the suspended pocket seat and/or the extended suspended pocket seat and said stool seat member are arranged at a longitudinal distance from each other.

According to an aspect the external cover member lower end comprise a first external cover zipper member and a second external cover zipper member. According to an aspect the first external cover zipper member is adapted to engaging with the internal fabric zipper member and/or the zipper member of the second end of the extension member and the second external cover zipper member is adapted to engaging with the stool seat zipper member. According to an aspect the length of the first external cover zipper member is shorter than the length of the second external cover zipper member.

According to an aspect the width of the external cover member lower end is arranged to be adapted to correspond to the length of the first and/or the second external cover zipper member.

According to an aspect the width of the external cover member lower end is arranged to be adapted by folding of the external cover member lower end.

According to one aspect, the stool seat member comprises a removable stool seat body arranged inside said stool seat member.

According to one aspect, the baby seat carrier further comprises side fasteners extending from said internal fabric member, the side fasteners being detachably attached to attachment points arranged on the external cover member such that the external cover member constitutes back support associated with the suspended pocket seat or the stool seat member of the stool seat.

According to one aspect, the internal fabric member is square or rectangular.

According to one aspect, an external cover member lower end comprise an external cover zipper member, the internal fabric member comprise an internal fabric zipper member, the stool seat member comprise a stool seat zipper member, the external cover zipper member being capable of engaging with the internal fabric zipper member and the stool seat zipper member. According to an aspect the first and second end of the extension member comprise a zipper member adapted to engaging with said internal fabric zipper member, said stool seat zipper member and/or external cover zipper member.

According to one aspect, an external cover member upper portion comprises a transverse stitched pattern adapted to facilitate transverse folding of the external cover member.

According to one aspect, the external cover member comprise two stitched bow patterns each extending longitudinally in a bowed-shape from an edge of the external cover member upper portion to an edge of the external cover member lower portion such as to facilitate easy folding of said external cover member along said stitched arm seams.

According to one aspect, the internal fabric member comprises more than one means for detachable attachment to the external cover member arranged at different lengths along the longitudinal direction of the internal fabric member.

The invention thereby achieves a baby seat carrier which may be adapted on a person by means of shoulder strap members and waist belt member prior an infant is arranged in the suspended pocket seat and/or arranged in the stool seat.

Further objects, features, advantages and properties of the baby seat carrier and method according to the invention will become apparent from the detailed description.

BRIEF DESCRIPTION OF THE DRAWINGS

In the following detailed portion of the present description, the invention will be explained in more detail with reference to the exemplary embodiments shown in the drawings, in which.

DETAILED DESCRIPTION OF THE INVENTION

Figure 1:
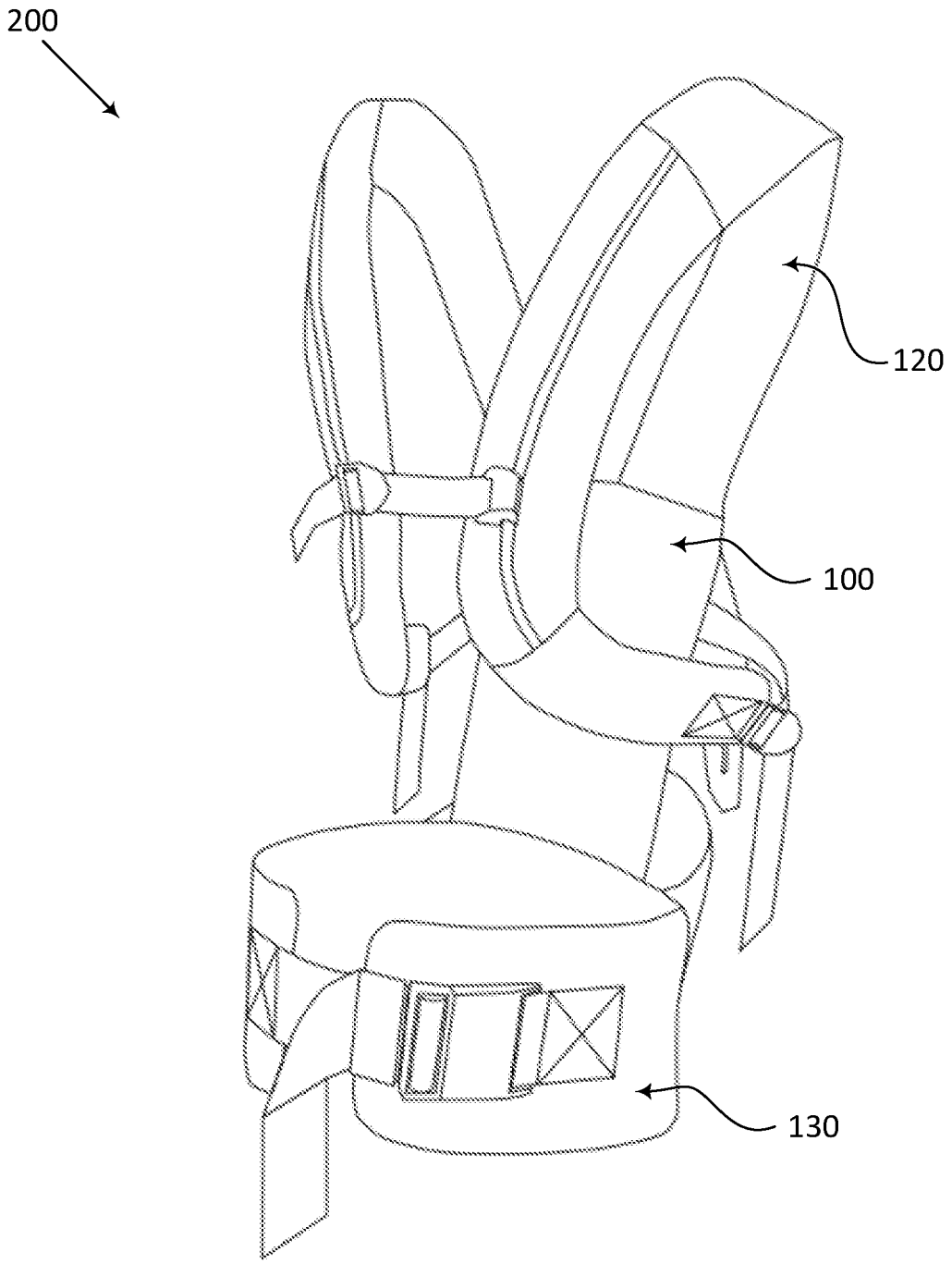
FIG. 1 is a perspective back/side view of one aspect of the present invention. Here depicted absent an external cover member.

In the following detailed description of the baby seat carrier 200 according to the invention will be described by the preferred embodiments/aspects. Throughout FIGS. 1-12, the same reference numbers refer to the same parts/features.

The construction and operation of means for detachable attachment such as zippers 155, 101, 172, 240 buttons/attachment points 161*a*, 161*b*, shoulder strap fasteners 121 as well as means for adjusting the length of strap members such as shoulder strap members 120 and waist belt member 130 is as such well-known and should not require further explanation in the present context.

Further details regarding the construction and operation of the baby seat carrier 200 according to aspects are provided below.

Figure 2:
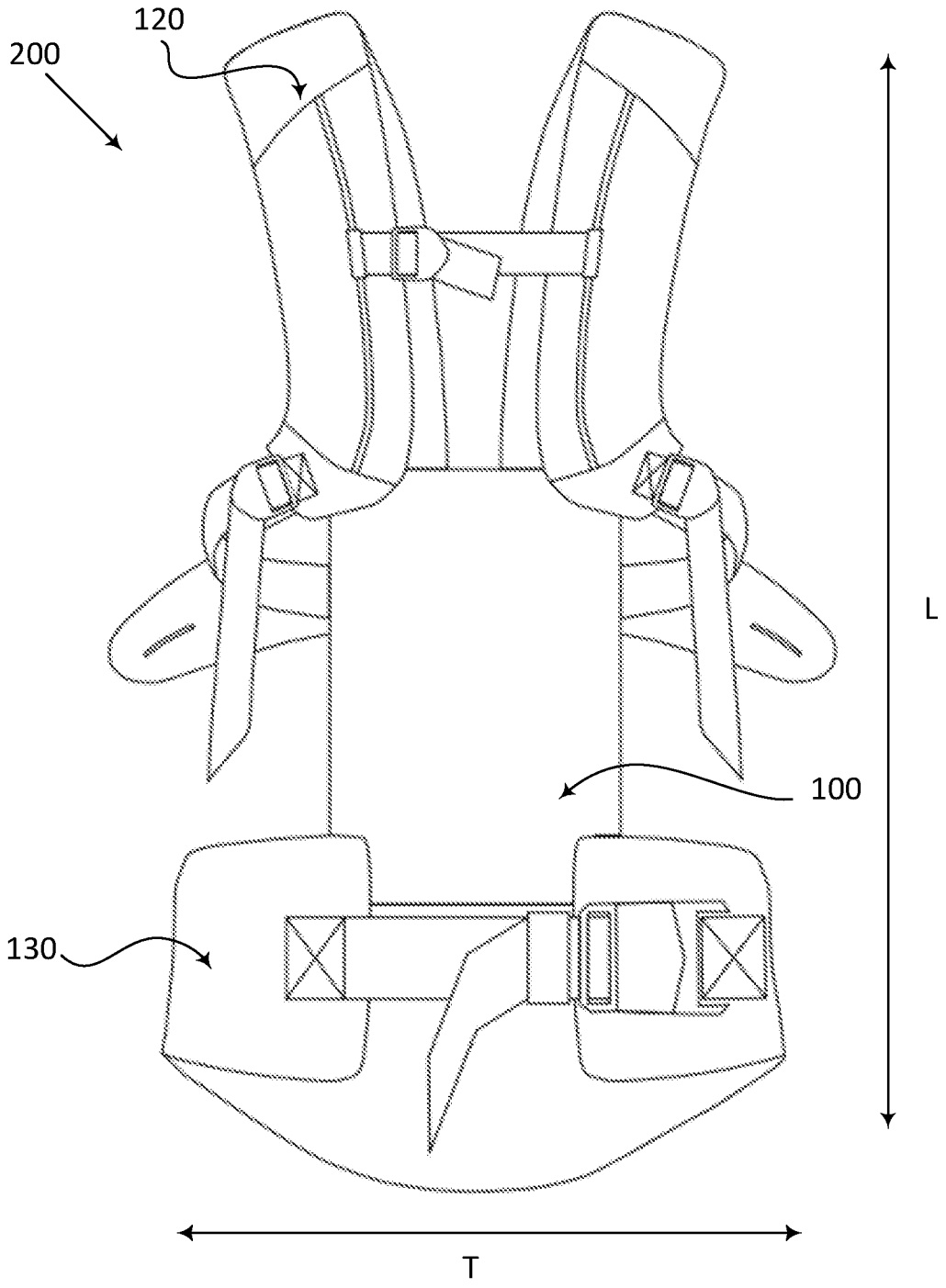
FIG. 2 is a perspective back view of one aspect of the present invention. Here depicted absent an external cover member.

FIGS. 1 and 2 shows a first exemplary aspect of the baby seat carrier 200, which is particular suitable for carrying of a baby. The baby seat carrier 200 comprises an internal plate-like fabric member 100 adapted to abut and extend along at least part of the torso of the user on which the carrier 200 is adapted. The baby seat carrier 200 may optionally be adapted along the back/spine or the chest/stomach/trunk of the person. The internal fabric member 100 is supplied with adjustable shoulder strap members arranged 120 at an upper end thereof and an adjustable waist belt member 130 arranged at a lower end thereof. FIG. 2 shows the longitudinal direction L and the transverse direction T of the baby seat carrier 200/internal fabric member 100.

Figure 3:
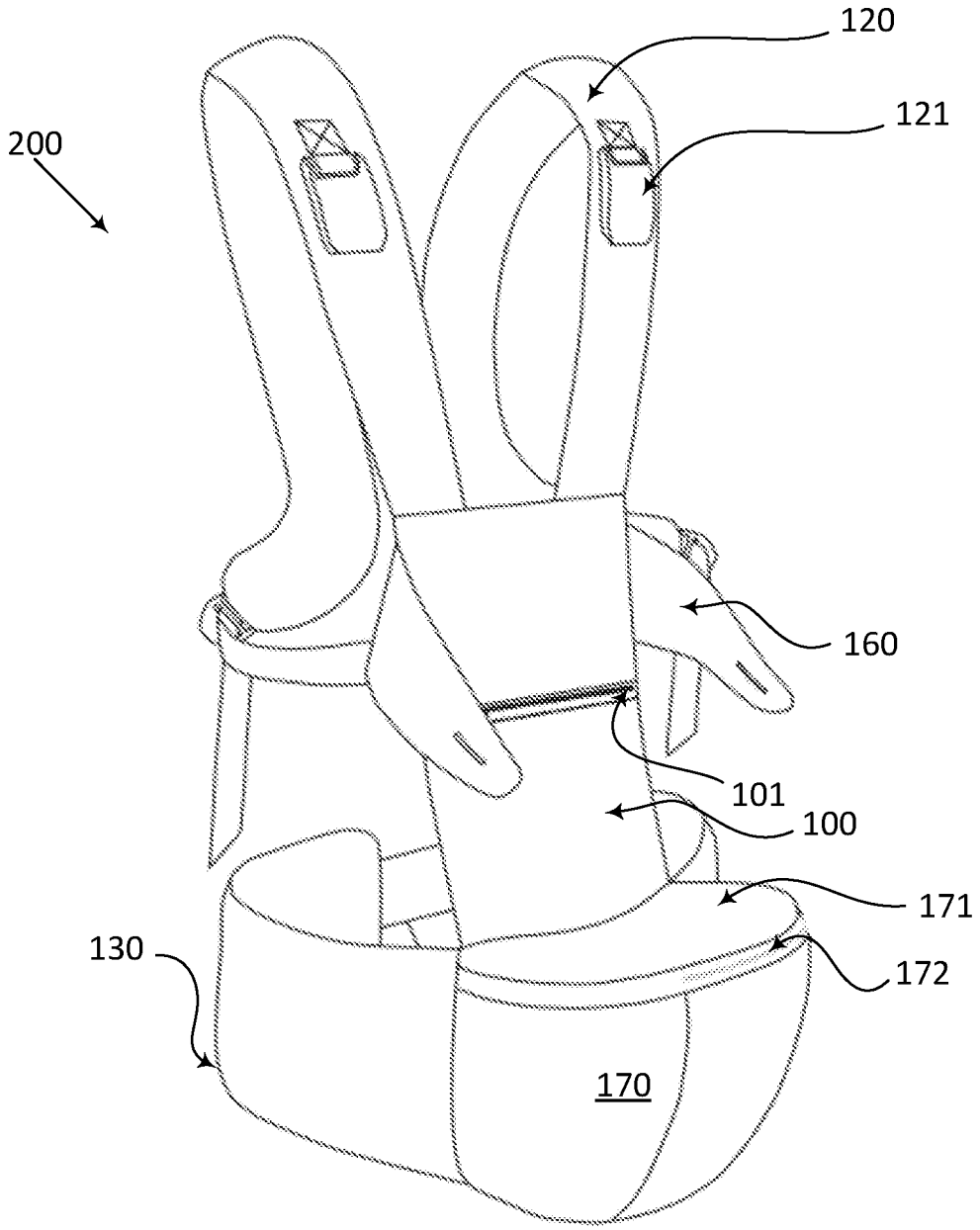
FIG. 3 is a perspective front/side view of one aspect of the present invention. Here depicted absent an external cover member.
Figure 4:
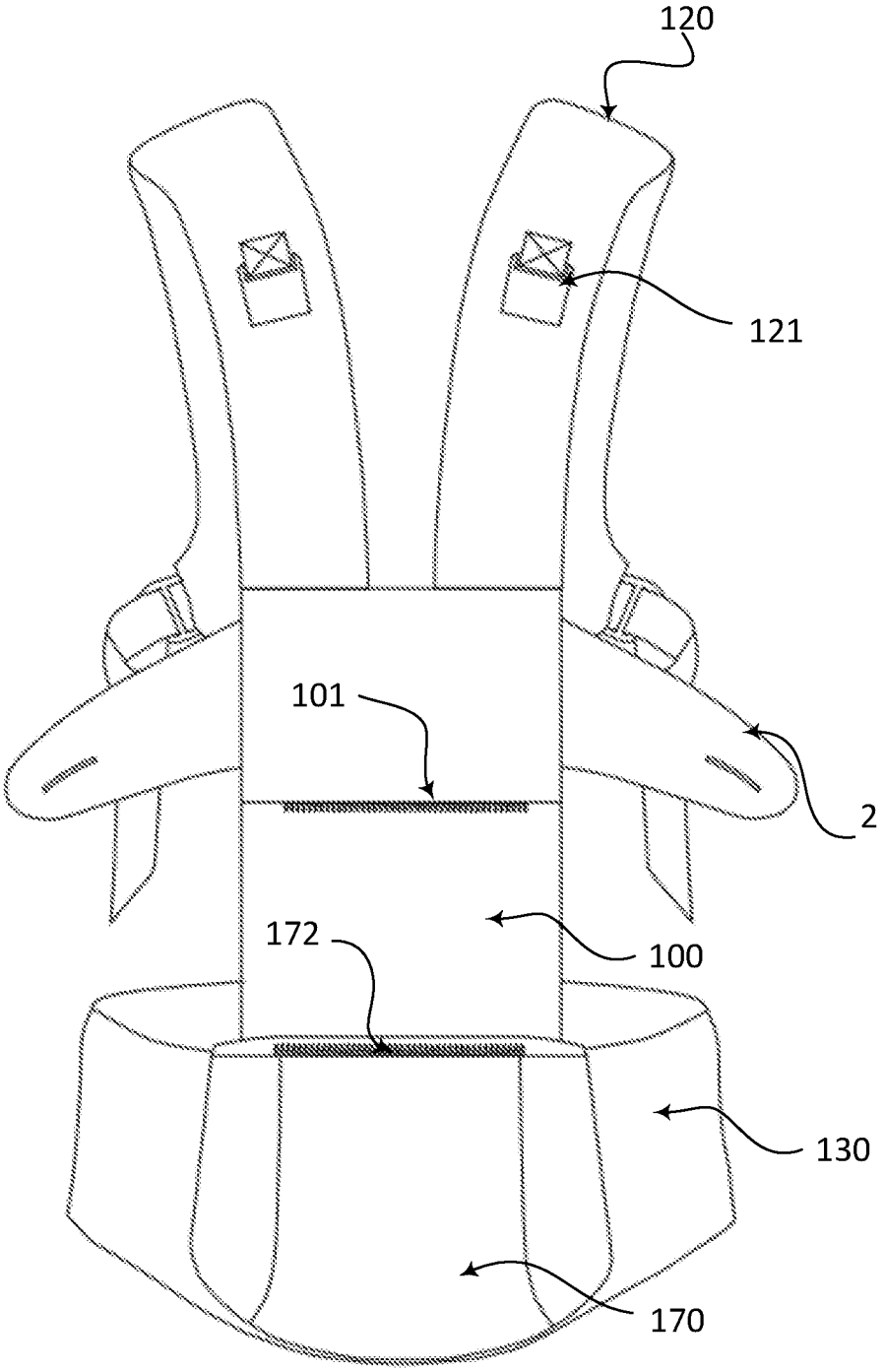
FIG. 4 is a perspective front view of one aspect of the present invention. Here depicted absent an external cover member.

FIGS. 3 and 4 shows in addition to the features shown in FIGS. 1 and 2, the shoulder strap fasteners 121 adapted on the shoulder strap members 120. Arranged on the outwards facing surface of the internal fabric member 100 is an internal fabric zipper member 101. According to aspects there may be arranged one or more zippers 101 on the internal fabric member 100 at various heights along the longitudinal direction L of the internal fabric member 100. Side fasteners 160 which extend from the longitudinal sides of the internal fabric member 100 may typically comprise straps.

Attached to the waist belt member 130 and/or the internal fabric member 100 is the stool seat member 170. The stool seat member 170 comprises a stool seat zipper member 172 arranged partially along the outer ridge of the stool seat member 170. The stool seat member 170 protrudes from the waist belt member 130 and has an upper seating surface 171. The upper seating surface 171 may be substantially flat or ergonomically shaped e.g. as an inverted child buttock. The stool seat member 170 may comprise a collapsible fabric shell in which a stool seat body 173 may be arranged.

Figure 5B:
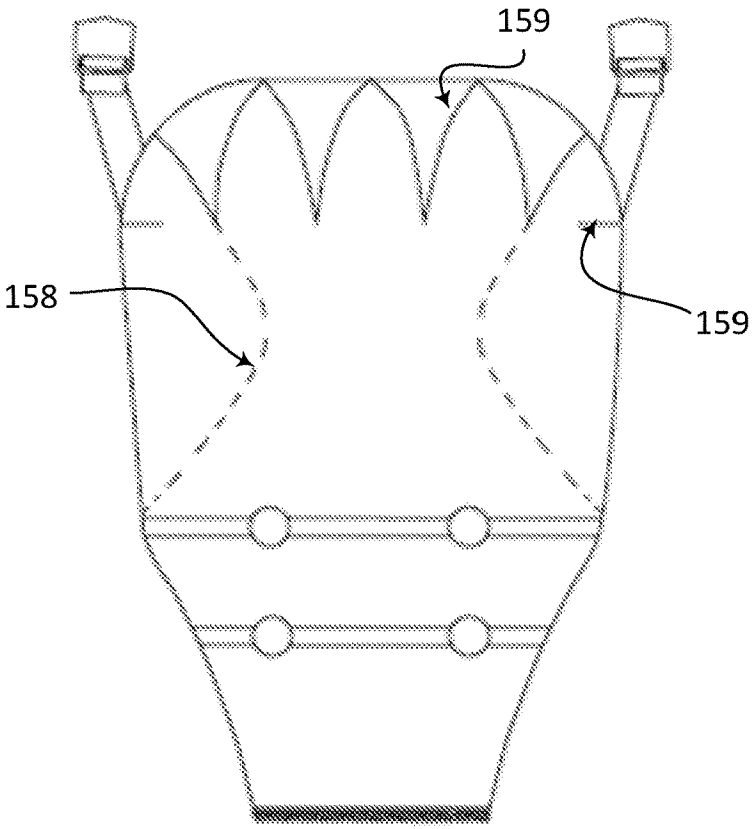
FIG. 5*b* is a perspective view of the external side of the external cover member according to one aspect of the present invention.
Figure 5A:
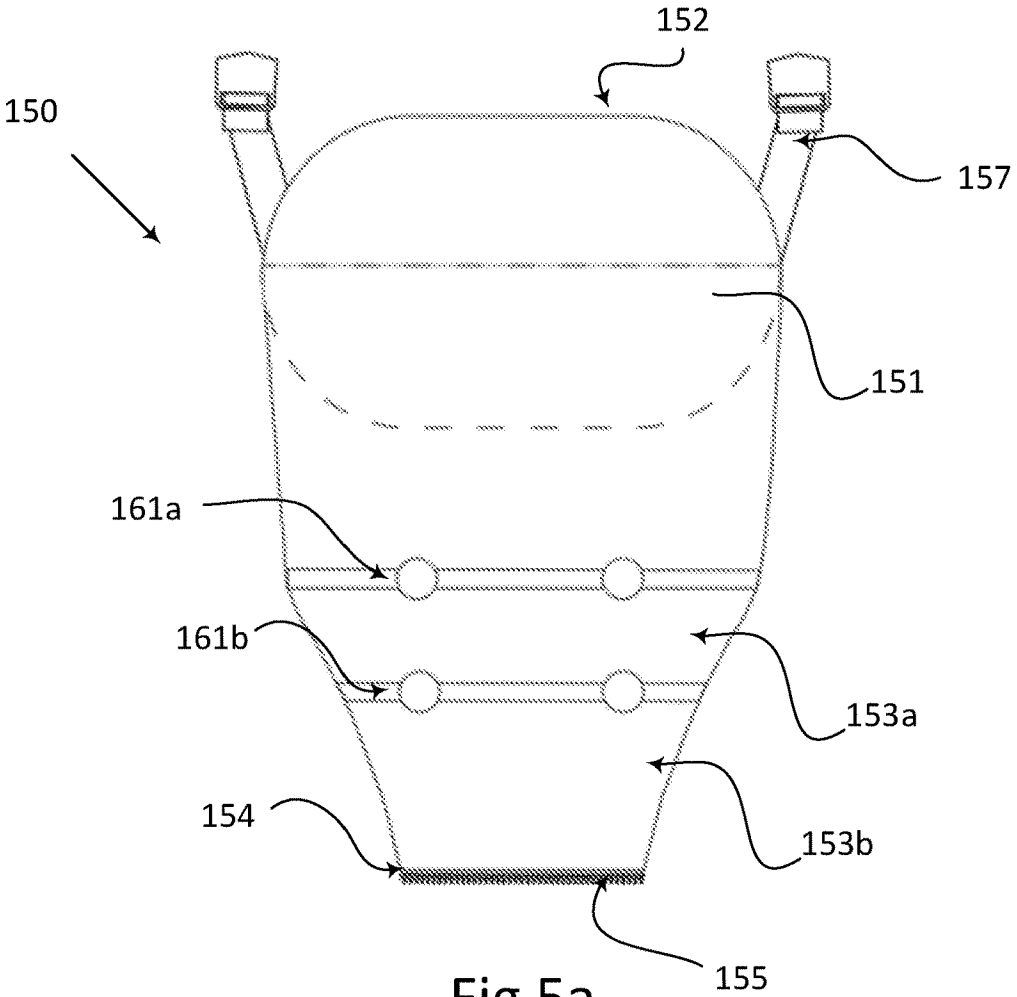
FIG. 5*a* is a perspective view of the external side of the external cover member according to one aspect of the present invention.

FIG. 5*a-b* illustrates an external cover member 150 according to aspects of the invention. In FIG. 5*a-b* the outwards facing surface of the external cover member 150 is shown. Arranged on the outwards facing surface there is arranged adjustable head straps 157 adapted to cooperate with shoulder strap fasteners 121 adapted on the shoulder strap members 120.

FIG. 5*a* further illustrate the external cover member lower section (–s) 153*a*, 153*b* and the external cover member lower end 154. The lower end 154 feature the external cover zipper member 155 adapted to detachably connect/engage with the internal fabric zipper member 101 and/or the stool seat zipper member 172.

Still referring to FIG. 5*a*, the external cover member 120 feature a pair of upper attachment points 161*a* and a pair of lower attachment points 161*b* adapted to cooperate with side fasteners 160. As is illustrated at least in FIG. 5, the external cover member 120 feature pairs of attachment points 161 arranged transverse at intervals on the external cover member 150.

According to further aspects, the side fasteners 160 may be arranged on the external cover member 120 and the attachment points 161 may be arranged on the internal fabric member 100.

FIG. 5*b* further illustrate a stitched arm pattern 158 and a stitched pattern 159 arranged on the upper portion 151 of the external cover member 150. The patterns 158 and 159 are intended to facilitate easy and maintained folding to the external cover member 150.

Figure 6:
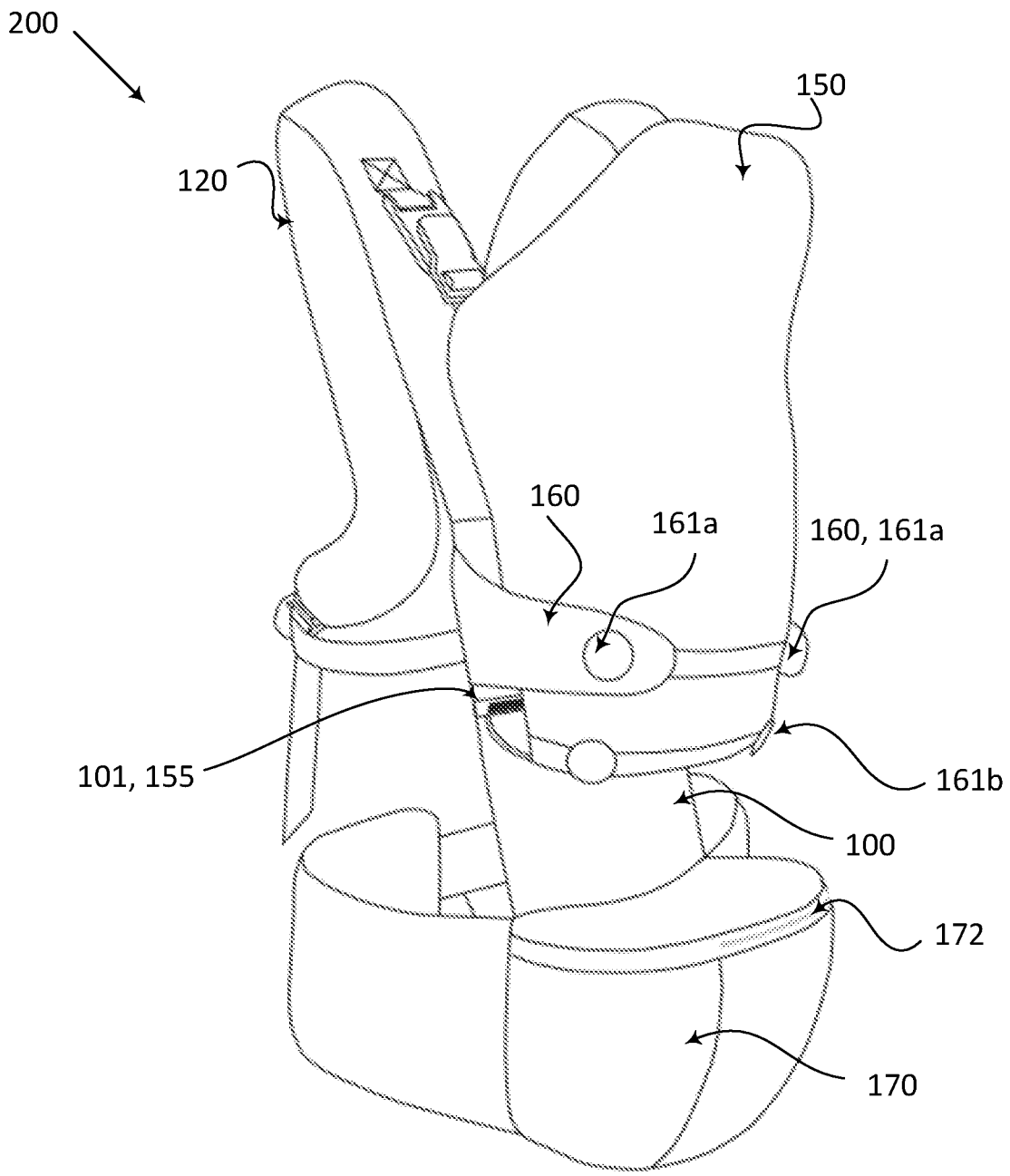
FIG. 6 is a perspective front/side view of one aspect of the present invention in the first mode of operation.
Figure 7:
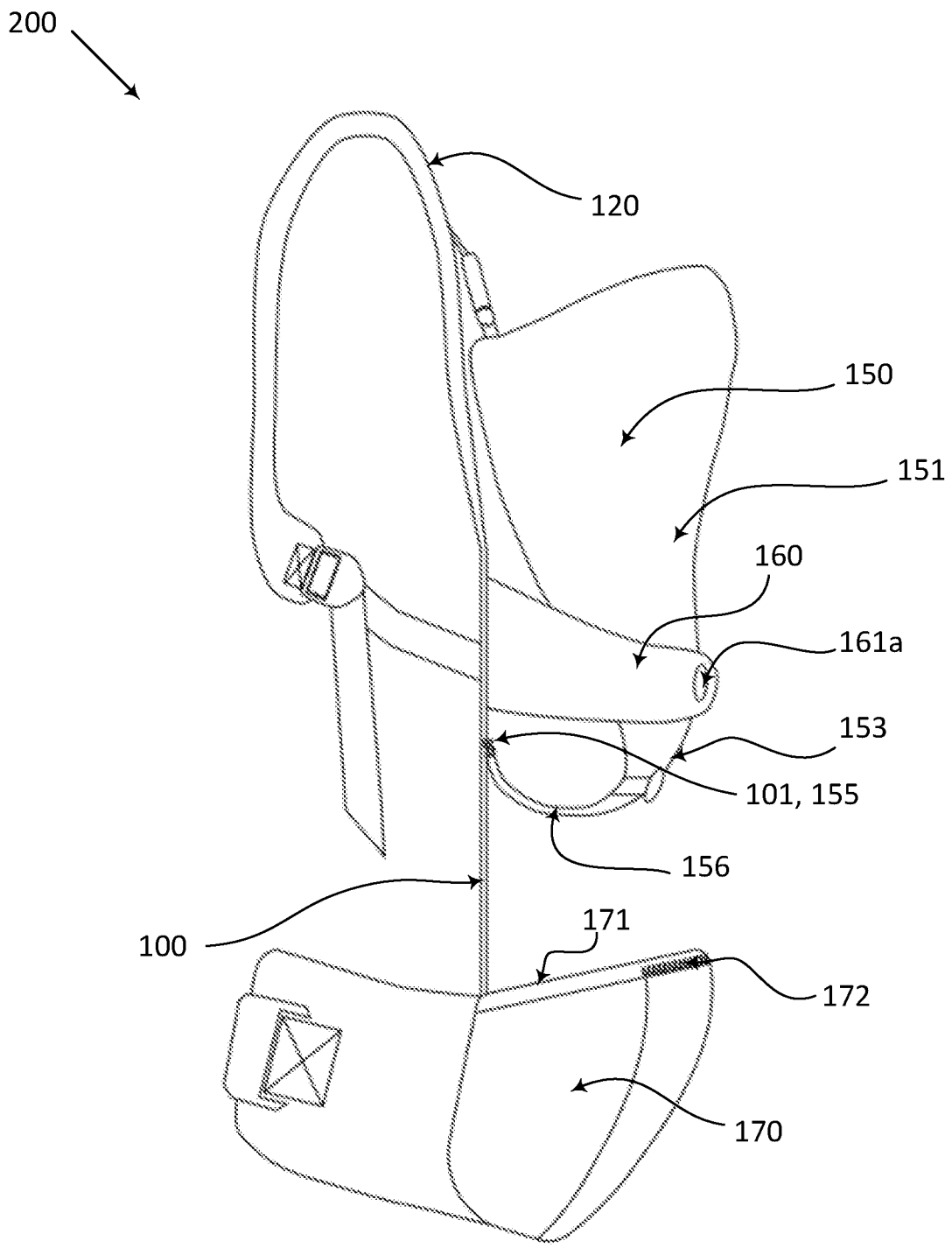
FIG. 7 is a perspective side view of one aspect of the present invention in the first mode of operation.

FIGS. 6 and 7 depicts the baby seat carrier 200 assembled/arranged in a first mode of operation suitable for use when carrying a baby approximately in the age of 0-6 months and/or having a C-shaped spine. The two side fasteners 160 engage with the pair of upper attachment points 161*a* and the external cover zipper member 155 engages in detachable connection with the internal fabric zipper member 101. The external cover member lower portion 153*b* is then arranged in a J-shape extending from the internal fabric member 100, forming the suspended U-shaped pocket seat 156 with the internal fabric member 100. When a baby is arranged on the suspended pocket seat 156, the side fasteners 160 and upper attachment points 161*a* and/or the upper portion 151 of the external cover member 120 provide support for the back and head of the toddler.

Figure 8:
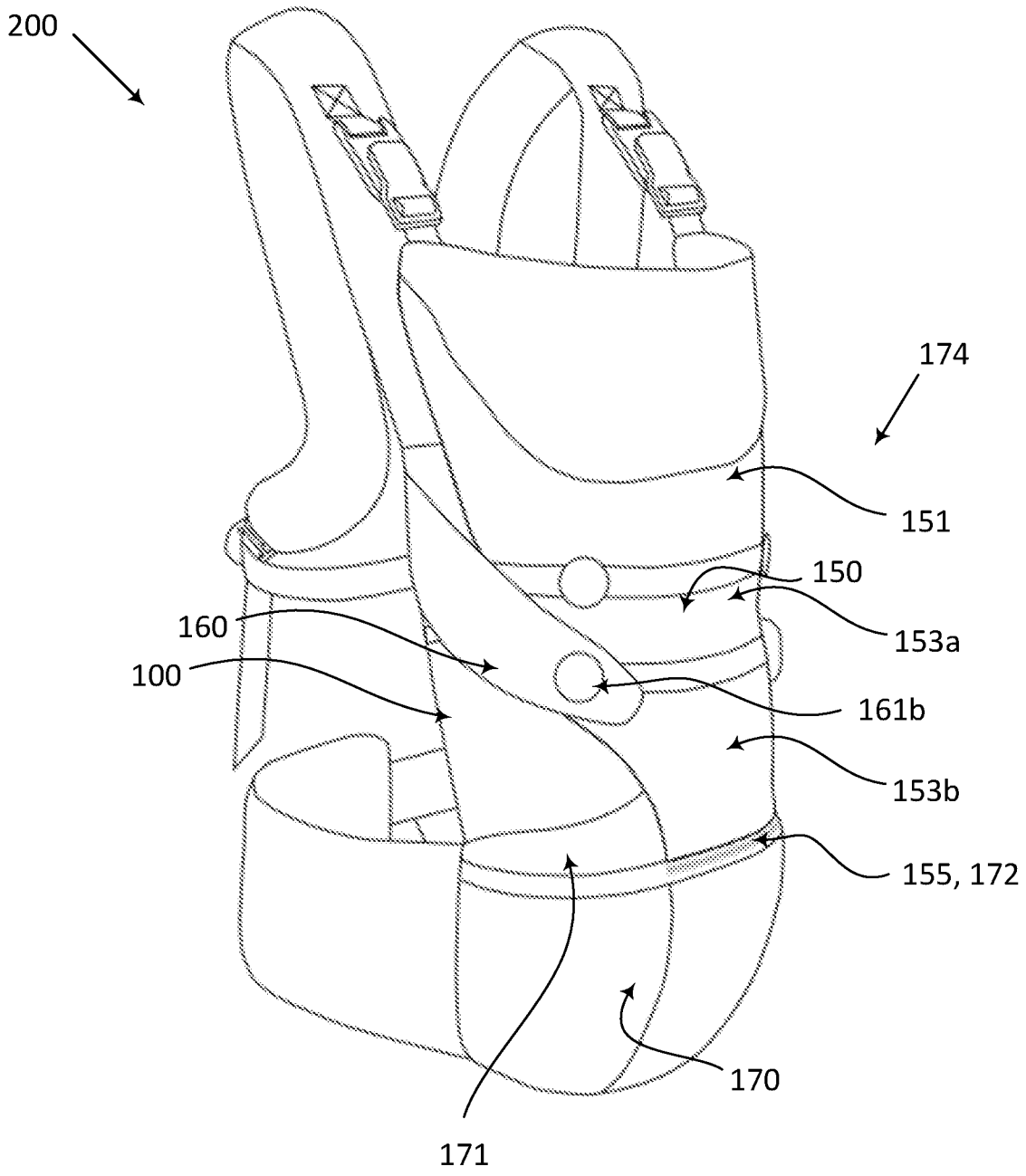
FIG. 8 is a perspective front/side view of one aspect of the present invention in the second mode of operation.
Figure 9:
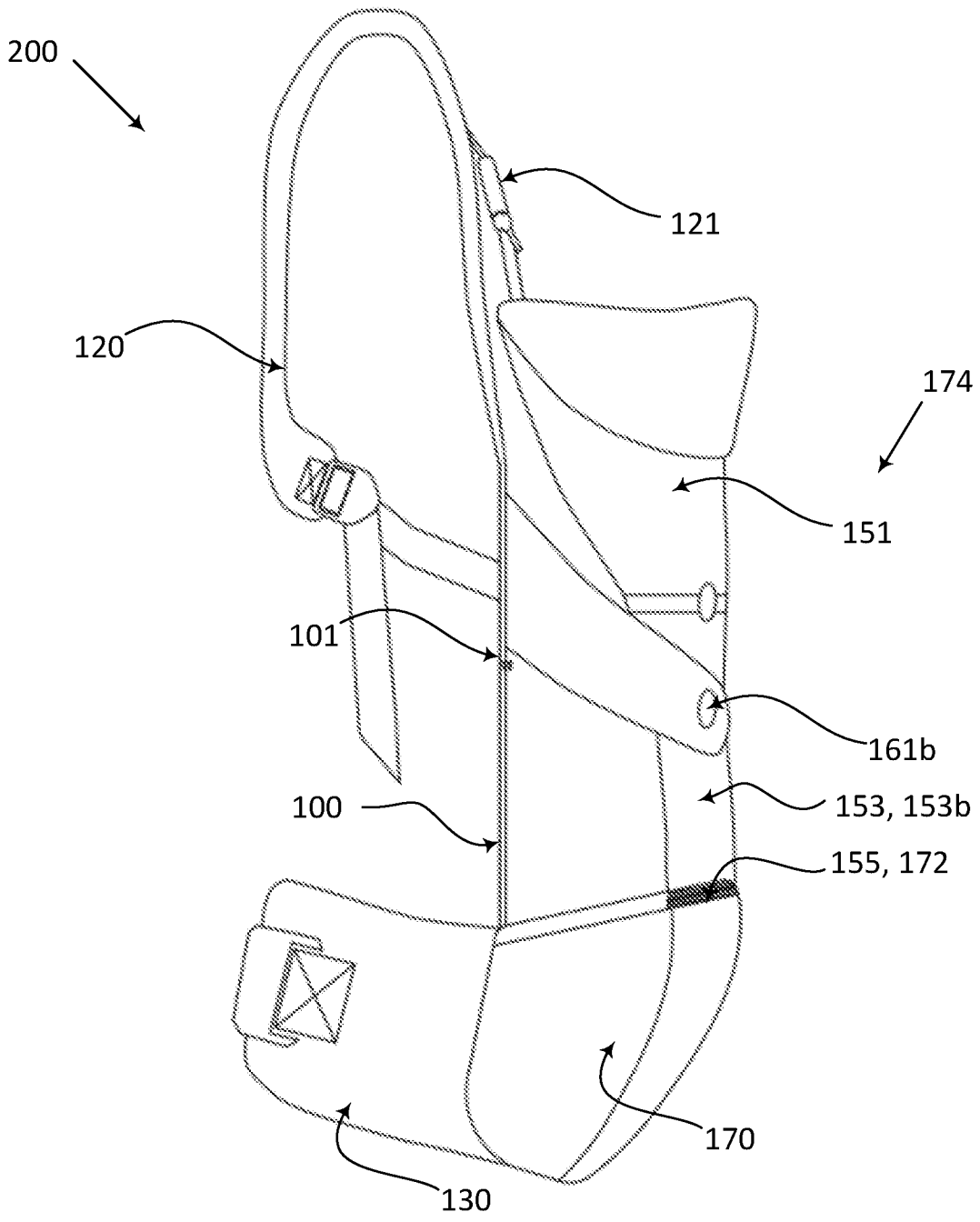
FIG. 9 is a perspective side view of one aspect of the present invention in the second mode of operation.

FIGS. 8 and 9 depicts aspects of the baby seat carrier 200 assembled/arranged in a second mode of operation suitable for use when carrying a baby approximately in the age of 6-36 months and/or having an S-shaped spine. The side fasteners 160 engage with the lower attachment points 161*b* to provide the baby with back and head support of the cover member 150. The external cover zipper member 155 engages in detachable connection with the stool seat zipper member 172. The external cover member lower section 153*b* and/or 153*a* is then arranged substantially in parallel with the internal fabric member 100 and/or perpendicular the stool seat upper surface 171, forming a back support for the baby and functioning as horizontal fixation means in relation to the internal fabric member 100. When a baby is arranged on the stool seat member 170, the side fasteners 160 and lower attachment points 161*b* and/or the upper section 151 of the cover member 120 provide support for the back and head of the baby. The stool seat member 170 and the external cover member 150 thereby form a stool seat 174.

Figure 10:
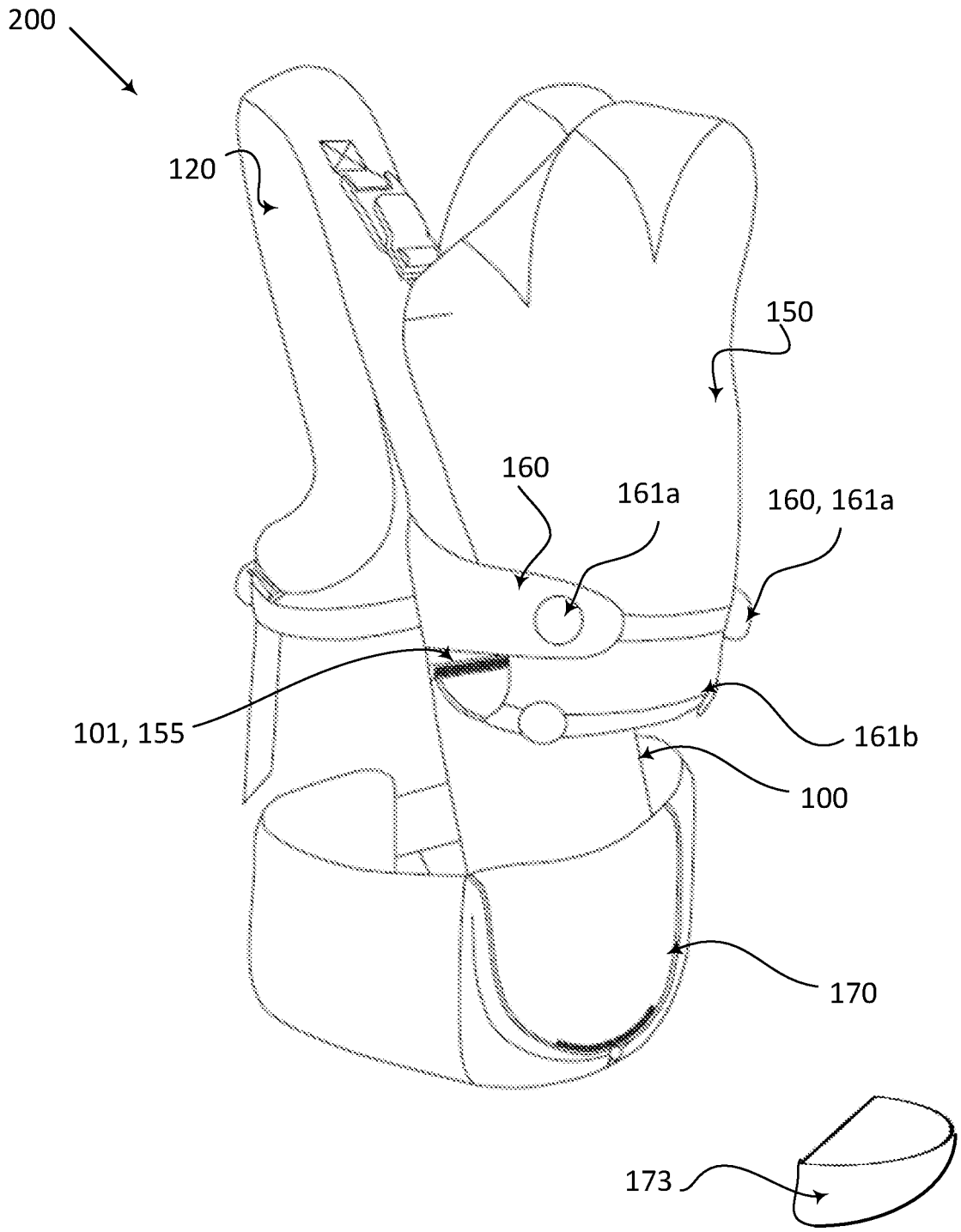
FIG. 10 is a perspective view of one aspect of the present invention depicted with the stool seat member removed from the stool seat member.
Figure 11:
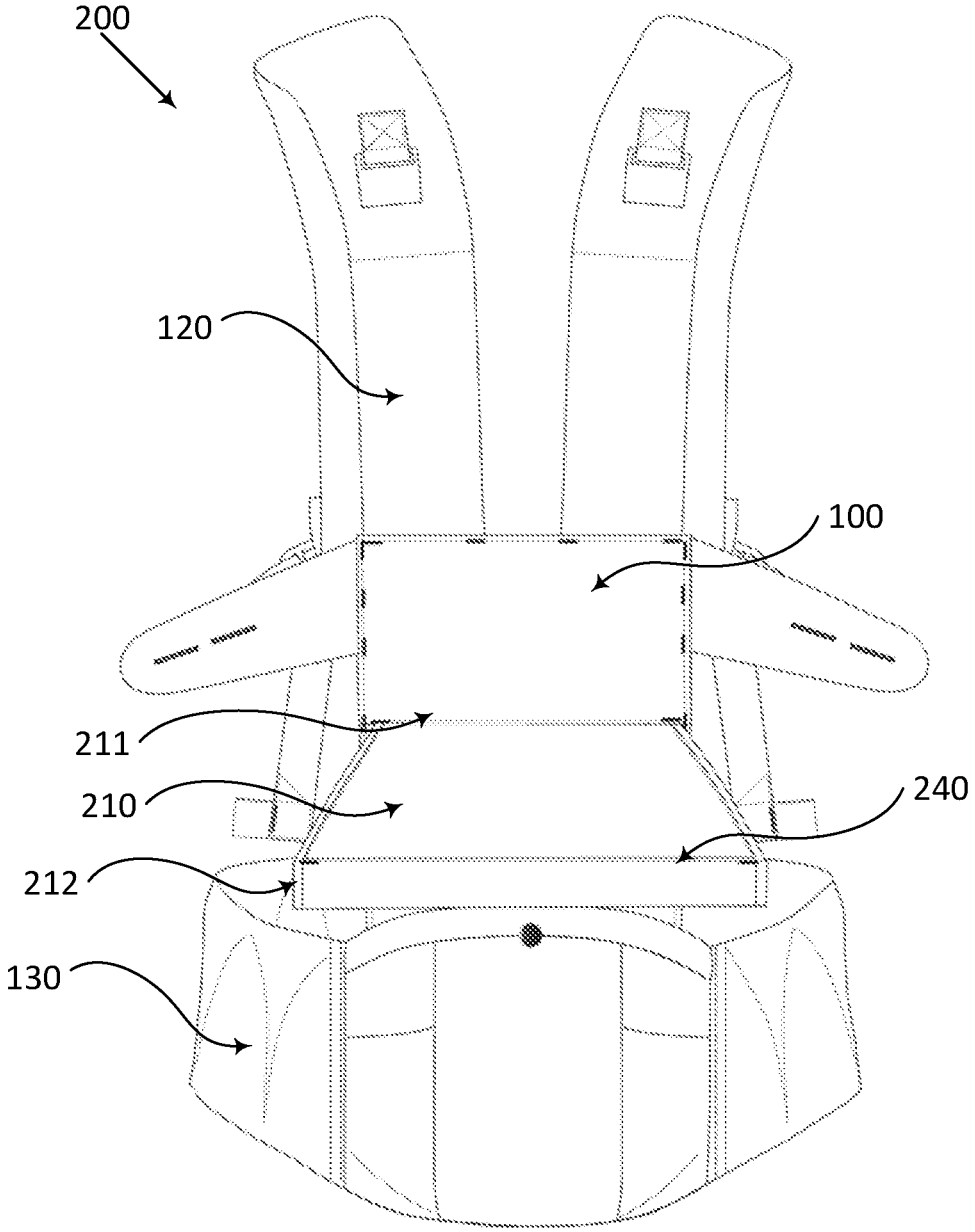
FIG. 11 is a perspective front view of one aspect of the present invention with an extension member and absent an external cover member.
Figures 12A, 12B, 12C:
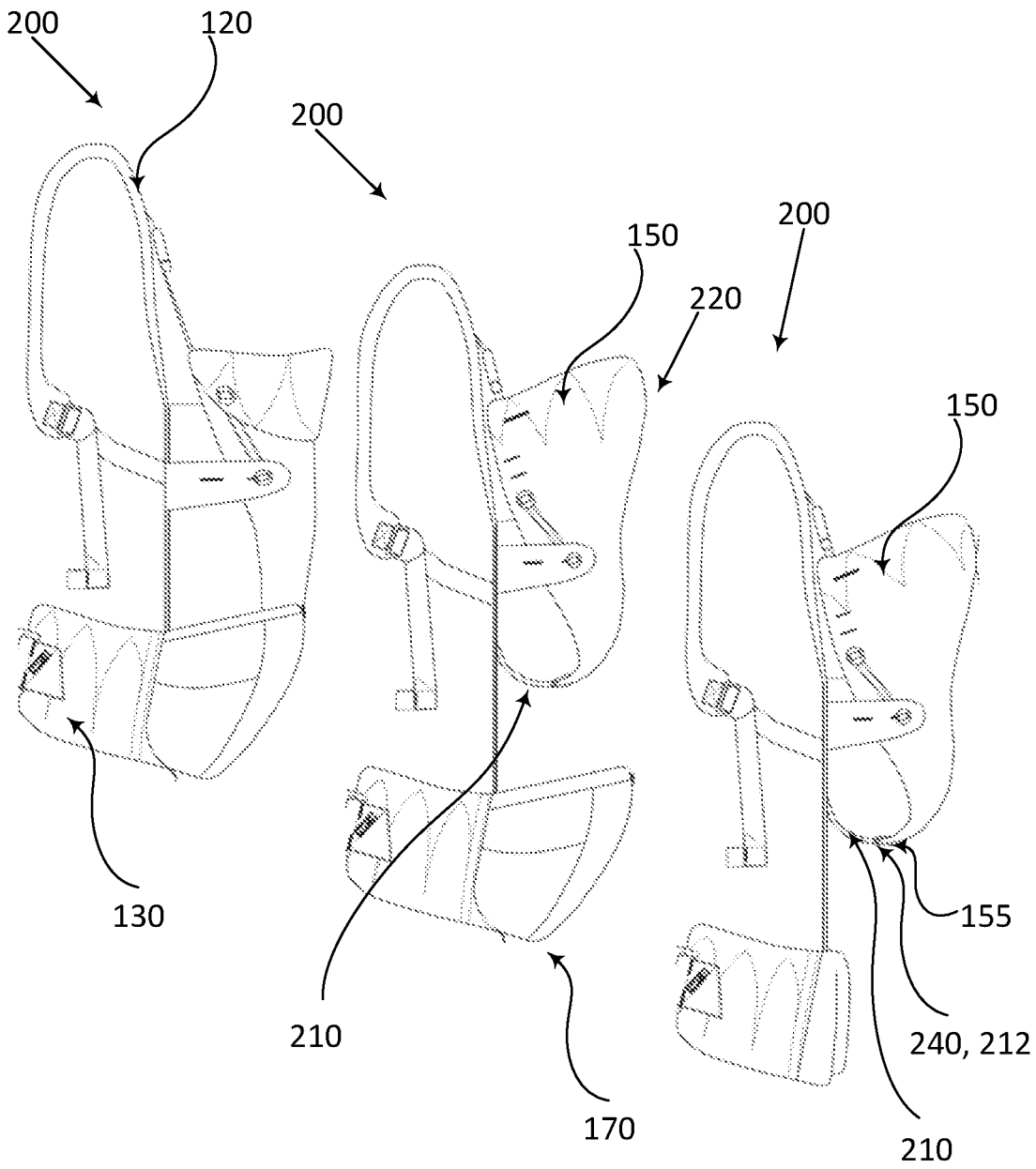
FIG. 12*a-c* is a perspective side view of an aspect of the present invention in the second mode of operation and in the first mode of operation in combination with an extension member and with and without the stool seat member.

FIG. 10 illustrate one aspect of the baby seat carrier according to the invention wherein the stool seat body member 173 has been removed from the stool seat member 170 and the stool seat member has been collapsed.

FIGS. 11 and 12*a-c* disclose a baby seat carrier 200 according to an aspect of the invention. The baby seat carrier 200 has an extension member 210. The extension member 210 has a first end 211 and a second end 212. The first end 211 of the extension member 210 is fixedly connected to the internal fabric 100. According to one aspect the first end 211 is detachably connected to the internal fabric. The second end 212 is detachably connected to the external cover member 150.

The second end 212 comprises a zipper member 240. The zipper member 240 is adapted to engaging with the external cover zipper member 172 to detachably connect the extension member 210 to the external cover member 150.

According to an aspect the first end 211 of the extension member comprise a zipper member. The zipper member of the first end 211 is adapted to engaging with the internal fabric zipper member 101 and/or stool seat zipper member 172.

According to an aspect the external cover member lower end 154 comprise a first external cover zipper member and a second external cover zipper member. The first external cover zipper member is adapted to engaging with the internal fabric zipper member 101. The first external cover zipper member is further adapted to engaging with the zipper member 240 of the second end 212 of the extension member 210. The second external cover zipper member is adapted to engaging with the stool seat zipper member 172.

According to one aspect the length of the first external cover zipper member is shorter than the length of the second external cover zipper member. The length of the first external cover zipper member could be optimized to the size of a baby that should be positioned in the pocket seat. The length of the second external cover zipper member could be optimized to the size of a baby that should be positioned in the stool seat.

According to an aspect the width of the external cover member lower end 154 is arranged to be adapted to correspond to the length of the first and/or the second external cover zipper member. The width of the external cover member lower end 154 is arranged to be adapted by folding of the external cover member lower end 154. The fabric between the first and second external cover zipper can be folded to not interfere with the legs of a baby positioned in the pocket seat. The fabric could be folded into a pocket of the external cover member. The possibility to change the width of the external cover member brings that the baby seat carrier can be adapted to be ergonomically optimized to the size of the baby both in its pocket seat position and in its stool seat position.

The internal fabric member 100, the extension member 210 and the external cover member 150 form an extended suspended pocket seat 220 when the extension member 210 is connected to the internal fabric member 100 and to the external cover member 150.

According to an aspect the stool seat member 170, the extension member 210 and the external cover member 150 form an extended stool seat 220 when the extension member 210 is connected to the stool seat member 170 and to the external cover member 150.

The extension member 210 can have different lengths and widths to adapt the size of the extended suspended pocket seat 220 and/or the extended stool seat 220 to the baby.

The extension member 210 can adapt the size of the baby seat carrier 200 to be even more ergonomically. Further, the extension member 210 makes is possible to have one or more further positions between the suspended pocket seat position and the pocket seat.

The internal structure/fabric/plate member 100 abuts and extends along the torso of the carrying person/user i.e. along the spine or trunk/chest of the user. The internal fabric 100 may be configured to enable adjustable weight distribution between the hips and shoulders of the user. The external cover member 150 which lower portion 153 may be detachably connected to the internal fabric member 100 to provide a suspended/hanging open pocket seat 156 which may be arranged relatively high up on the torso/chest of the user at a distance from the stool seat member 170.

The baby seat carrier 200 may be provided with an adjustable external cover member 150 which lower end 154 and/or lower portion 153 may be detachably connected to a stool seat member 170, which stool seat member 170 may be arranged on a waist belt member 130 adapted to facilitate weigh distribution to the hips of the user. The waist belt member 130 may be attached to a lower portion 153 of the internal fabric member 100.

The baby seat carrier 200 may feature an internal plate-like fabric structure member 100 configured to abut the torso of the user on which the baby seat carrier 200 is adapted. When the baby seat carrier 200 is arranged on a user, for example on a front side of a user, the internal fabric typically extends from the waist to the chest of the user, whereby a soft fabric is advantageous in that it may conform to the shape of the user.

The internal fabric member 100 may be configured to extend between the waist belt member 130 and shoulder strap members 120 adapted to distribute weight from the internal fabric member 100 to the shoulders of the user. The shoulder strap members 120 may be arranged on an upper portion and/or upper end of the internal fabric member 100 and comprise means for adjusting the length of said shoulder strap members 120. The waist belt member 130 may be attached to a lower portion and/or lower end of the internal fabric member 100 and comprise means for adjusting the length/diameter of the waist belt member 130. The waist belt member 130 and/or the shoulder strap members 120 may feature protective padding or like which provide comfort and/or improved weight distribution.

The baby seat carrier 200 may comprise a seat/stool member 170 extending in a plane approximately transverse a plane of the internal fabric member 100. The stool seat member 170 may extend from the waist belt member 130 and outwards from the torso of the user on which the baby seat carrier is adapted. The stool member 170 may comprise a firm/rigid stool seat body 173. A vertical load on the seat member 170 may thereby be distributed to the waist belt member 130 and/or the internal fabric member 100 and to the shoulder strap members 120.

The baby seat carrier 200 may comprise an external cover member 150 extending along a longitudinal direction L of the internal fabric member 100. The longitudinal direction L typically corresponds to the direction of the spine/torso/trunk of the person on which the baby seat carrier 200 is adapted. The external cover member 150 may according to aspects constitute an outer shell of the baby seat carrier 200. The external cover member may comprise a foldable plate of fabric which may be padded or partially padded. In a non-limiting example the external cover member 150 comprises two sheets of fabric with padding arranged there between.

The lower portion 153 and/or a lower end 154 of the external cover member may comprise means 161, 161*a*, 161*b* for detachable attachment/engagement to the internal fabric member 100.

The external cover member means 161, 161*a*, 161*b* for detachable attachment may extend along a transverse direction of the external cover member.

The said internal fabric member 100 may comprise corresponding means 160 for detachable attachment to the means 161, 161*a*, 161*b* for detachable attachment of the external cover member 150.

The internal fabric member 100 may feature means 101 for detachable attachment/connection to the external cover member 150 which means 101 may be arranged removed from the upper end and the lower end of the internal fabric member 100.

The internal fabric member means for detachable connection 101 may extend along a transverse direction T of the internal fabric member 100.

The baby seat carrier 200 may be configured in a first mode of operation wherein lower portion 153 of said external cover member 150 is detachably connected to the internal fabric member 100.

The baby seat carrier 200 may be adapted in the first mode of operation suitable for the carrying of infants having a C-shaped spine. In the first mode of operation a lower portion 153 of the external cover member 150 may extend from the internal fabric member 100 to form an open U-shaped pocket seat 156. The said U-shaped pocket seat 156 may be said to comprise an !-shaped internal fabric member 100 and a J-shaped external cover member 150 where the opening of the J-shaped external cover member faces the internal fabric member 100.

Thereby, according to aspects of the invention, the external cover member 150 may be detachably connected to the internal fabric member 100 to form a suspended pocket seat 150.

The J-shaped external cover member 150 may form/conform about the groin and the back of the baby and the internal fabric member 100 abuts the stomach and/or chest of the baby.

The lower portion of the external cover member 153, 153*a*, 153*b* may form/conform to the groin of the baby.

The upper portion 151 of the external cover member forms about the back and/or head of the baby.

The suspended pocket seat 156 may have open ends such as to facilitate that the baby's legs are freely suspended outside the said pocket seat 156 and the baby's legs may extend out from the open ends of the U-shaped pocket seat 156.

The internal fabric member 100 may comprise more than one means 101 arranged at an interval or intervals along the longitudinal length L of the internal cover member 100.

Thus, the means 101 for detachable attachment arranged on the internal fabric member 100 and the external cover member 150 facilitate that the external cover member 150 may extend partially along and/or variably partially along the length of the internal fabric member 150 and shoulder straps 120, preferably along an upper portion of the internal fabric member 151. The invention thereby achieves that the said external cover member 150 and/or lower section 153 of the external cover member 150 may be arranged to form a suspended pocket seat 156. According to aspects the lower portion 153 of the external cover member 150 forms the pocket seat and the upper portion 151 of the external cover member 150 forms an associated back support/horizontal fixation means for a baby arranged on/in the pocket seat 156.

A vertical or substantially vertical force/load exerted on the suspended pocket 156 seat e.g. from a baby arranged in the said pocket seat 156 between the internal fabric member 100 and the external cover member 150, may thereby be countered/absorbed/supported/distributed by the internal fabric member 100 and the external cover member 150. The first mode of operation may be suitable for a baby having a C-shaped spine and/or arranged in a frog/fetal position. In the first mode of operation the suspended pocket seat 156 formed by the lower portion 153 of the external cover member may conform to the groin of the baby and provide evenly distributed support to the baby while the remainder of the external cover member 150 conforms to the spine of the baby, providing horizontal support.

The external cover member may feature a stitched pattern 159, for example a wave pattern or a stitched transverse line extending over the external cover member 150. The stitched pattern 159 may penetrate the fabric and the padding of the external cover member 150 such that said padding is compressed locally at the stitch/seams and thus facilitate easy and maintained folding of the external cover member 150 along a substantially transverse direction T across the external cover member 150.

The parts of the external cover member 150 which are intended to abut the arms of a baby arranged in the provided pocket seat 156 and/or stool seat 174 may each respectively be surrounded/delimited by a stitched bow pattern 158. The stitched bow pattern 158 may penetrate the fabric and the padding of the external cover member 150 such that said padding is compressed locally at the stitch/seams and thus weaken structural rigidity of the external cover member 150 and facilitate easy folding of the external cover member 150 and provide reduced resistance to folding when the baby moves its arms. The stitched bow pattern 158 may extend between the upper portion 151 and/or an edge of the upper portion of the external cover member 150 to an edge of the lower portion 153 and/or close proximity of the lower portion 153 of the external cover member wherein the bow in the bow-shape points towards the center of the external cover member 150 and is open towards the longitudinal edge of the external cover member 150.

The baby seat carrier 200 may be configured in a second mode of operation suitable for the carrying of a baby approximately in the age of 6-36 months. In the second mode of operation the lower portion 153 and/or lower end 154 of the cover member 150 is adapted to be detachably connected to a stool seat member 170 to yield a stool seat 174. The stool seat 174 may feature the stool seat member 170 as seat and the external cover member 150 as associated back rest/back support and head support.

The lower portion of the external cover member 153*a*, 153*b* is further adapted to be detachably connected the stool seat member 170.

The lower portion 153 of the external cover member 150 is further adapted to be detachably attached/connected to an outer ridge of the stool seat member 170 such that the lower portion 153*a*, 153*b* of the external cover member extend in parallel or substantially in parallel with the internal fabric member 150 such as to provide means for horizontal fixation of a baby arranged on the stool seat member 170. The outer ridge of the stool seat member 170 may be defined as the ridge or part of the ridge which is separated from the body of the user by the stool seat member 170. The lower portion of the external cover member 153*a*, 153*b* may thereby provide a back/spine support for the baby associated with the stool seat member 170. The second mode of operation is suitable for babies with the S-shaped spine which may require a firm flat seat provided by the stool seat member 170 of the stool seat 174 and adequate back support provided by the external cover member 150.

The stool seat member 160 may comprise fabric shell or fabric compartment which may be collapsible/foldable and into which shell/compartment a removable stool seat body 173 may be arranged. When collapsed, the upper surface of the stool seat member 171 may fixated to the waist belt member by means of a ridge zipper member extending along the ridge of the stool seat member upper surface 171 which ridge zipper member engages with an associated waist bet zipper arranged on the waist belt member 130.

The baby seat carrier 200 further comprises side fasteners 160 extending from the internal fabric member 100 to the external cover member 150. The side fasteners 160 may distribute horizontal and/or vertical forces exerted on the external cover member 150 to the internal fabric member 100. The side fasteners 160 may extend from the longitudinal sides of the internal fabric member 100 to the external cover member 150 such that orifices/holes are formed between the side fasteners 160 and the suspended pocket seat 156 and the stool seat member 170. The orifices/holes may be adapted such that a respective leg of a baby arranged on the suspended pocket seat 156 and/or the stool seat 174 may pass through a respective orifice.

The side fasteners 160 may be adapted to be detachably attached to the external cover member 150 at attachment points 161*a*, 161*b* arranged on the outside of the external cover member 150 and/or along a longitudinal length of the external cover member 150 such as to facilitate back support for a baby and/or adjustable height of the pocket seat 156 in relation to the internal fabric member 100.

The fixation points 161*a*, 161*b* may comprise pairs of fixation points. In a non-limiting example, the fixation points 161*a*, 161*b* comprise pairs of buttons arranged laterally along two or more transverse lengths of the external cover member 150. The fixation points 161 in a pair of fixation points may be attached to the external cover member 150 as well as internally to each other by means of e.g. a connecting belt or like, extending between the two fixations points constituting a pair of fixation points.

The stool seat member 170 may be detachably attached to the internal fabric 100 member and/or to the waist belt member 130.

The said internal fabric member 100 may comprises a square, rectangular or any other suitable shape.

The lower end of the external cover member 154 may comprise an external cover zipper member 155 which may engage in detachable connection to an internal fabric zipper member 101.

The stool seat member 170 may comprise a stool seat zipper member 172. The external cover zipper member 155 may be further adapted to engage in detachable connection to the stool seat zipper member 172. The stool seat zipper member 172 may preferably be arranged on or in close proximity of an outer ridge of the stool seat member and extend at least partially along the length of the outer ridge.

The internal fabric member 100 may be soft fabric. The internal fabric member may be padded and/or reinforced by means of a mesh structure. The internal fabric member 100 may be reinforced internally and/or externally.

The means for detachable connection of the external cover member 150 to the internal fabric member 100 comprise means for enabling stepless height adjustment of the external cover member 150 and/or the lower end 154 thereof in relation to the internal fabric member 100 such as to stepless adjust the distance between the suspended pocket seat 156 and the stool seat member upper surface 171.

The stool seat member may protrude outwards from the internal fabric member 100 and/or waist belt member 130 such that the upper surface 171 of the stool seat is arranged transverse plane of the internal fabric member 100 or slightly inclined towards the internal fabric member 100.

The stool seat member 170 may comprise a cushion like stool seat body 173 or like member. The material of the stool seat body 173 is preferably made from a firm/rigid material which is light weight material, for example expanded polystyrene (EPS) or expanded polypropylene (EPP) but may also comprise a hollow shell an inflatable cushion. According to aspects the stool seat member 170 is attached to the internal fabric member 100 and/or waist belt member 130, thereby vertical forces exerted on the stool seat member 170 may be transferred from the stool seat member 170 and distributed between the waist belt member 130 and/or the shoulder strap members 120.

The skilled reader will appreciate that elements and/or features of the baby seat carrier 200 may according to aspects be substituted for equivalents. For example, the said zipper members 101, 155, 172, 240 may be substituted by equivalents, providing similar detachable attaching functions.

The materials used in the construction of the baby seat carrier 200 may vary and the skilled reader will appreciate that the baby seat carrier may come in various versions such as comfort versions e.g. provided with additional padding and or support, light weight versions made from lightweight materials or exclusive material versions.

When arranging a baby in the suspended pocket seat 156, the baby seat carrier is arranged in the first mode of operation comprising the following steps:

- arranging shoulder strap members 120 and/or waist belt member 120 on the user carrying the baby seat carrier;
- arranging the lower portion 153*a*, 153*b* of the external cover member substantially transverse the longitudinal direction L of the internal fabric member 100;
- detachably connecting the lower portion 153*a*, 153*b* and/or lower end 154 of the external cover member 150 to the internal fabric member 100 by means of internal fabric zipper member 101 and external cover zipper member 155;
- arranging an upper portion 151 of the external cover member 150 substantially in parallel with the internal fabric member 100;
- detachably attaching side fasteners 160 to upper attachment points 161*a* arranged on the external cover member 150;
- arranging the baby in the pocket seat 156 having the respective legs arranged underneath the side fasteners 160.
- connecting head straps 157 to shoulder strap fasteners 121.

Upon rearranging the baby from the suspended pocket seat 156 to the stool seat 174, the baby seat carrier is arranged in the second mode of operation comprising the following steps:

- detaching the head straps 157 from the shoulder strap fasteners 121;
- removing the baby from the pocket seat 156;
- detaching the external cover zipper member 155 from the internal fabric zipper member 101;
- detachably connecting the external cover zipper member 155 to the stool seat zipper member 172;
- arranging the baby on the stool seat member 170;
- detachably attach the side fasteners 160 to the lower fixation points 161*b;*
- connecting head straps 157 to shoulder strap fasteners 121.

It should be noted that the above sequence of steps for arranging the baby seat carrier in a first and second mode of operation is for explanatory purposes and the baby seat carrier 200 is not limited to be used exclusively according to the above steps for arranging the baby carrier.

The invention thereby achieves a baby seat carrier 200 which may be adapted on a person by means of shoulder strap members 120 and waist belt member 130 prior a baby is arranged in the suspended pocket seat 156 and/or arranged in the stool seat 174.

Consequently, the invention provides a great variety of possible designs and adaptation of a baby and baby seat carrier system.

Although the teaching of this application has been described in detail for purpose of illustration, it is understood that such detail is solely for that purpose, and variations can be made therein by those skilled in the art without departing from the scope of the teaching of this application.

The term "comprising" as used in the claims does not exclude other elements or steps. The term "a" or "an" as used in the claims does not exclude a plurality.

NOMENCLATURE

100 Internal plate/fabric member
101 Internal fabric zipper member
120 Shoulder strap member
121 Shoulder strap fastener
130 Waist belt member
150 External cover member
151 External cover member upper portion
152 External cover member upper end
153*a* External cover member lower portion
153*b* External cover member lower portion
154 External cover member lower end
155 External cover zipper member
156 Pocket seat/suspended pocket seat
157 Head straps
158 Stitched bow pattern
159 Stitched pattern
160 Side fastener
161 Attachment point
161*a* Upper attachment point
161*b* Lower attachment point
170 Stool seat member
171 Stool seat member upper surface
172 Stool seat zipper member
173 Stool seat body
174 Stool seat
200 Baby seat carrier
L Longitudinal direction of baby seat carrier/internal fabric member/external cover member
T Transversal/lateral direction of baby seat carrier/internal fabric member/external cover member

The invention claimed is:

1. A baby seat carrier comprising shoulder strap members; a waist belt member; a stool seat member connected to said waist belt member; an internal fabric member configured to abut and extend along the torso of a carrying user and that is connected to the waist belt member and the shoulder strap members; an external cover member extending along a longitudinal direction (L) of said internal fabric member, said external cover member having a lower portion that is detachably connected to said internal fabric member such that said external cover member and said internal fabric member form a suspended pocket seat;

wherein said lower portion of said external cover member is further adapted to be detachably connected to said stool seat member such that the stool seat member and the external cover member form a stool seat.

2. The baby seat carrier according to any claim 1, further comprising an extension member that at a first end is arranged to be detachably connected to the internal fabric member and at a second end is arranged to be detachably connected to the lower portion of said external cover member such that the internal fabric member, the extension member and the external cover member form an extended suspended pocket seat.

3. The baby seat carrier according to claim 2, wherein the first end of the extension member is fixedly connected to the internal fabric member.

4. The baby seat carrier according to claim 1, wherein said suspended pocket seat and/or the extended suspended pocket seat and said stool seat member are arranged at a longitudinal (L) distance from each other.

5. The baby seat carrier according to claim 1, wherein said stool seat member comprises an outer ridge and said lower portion of said external cover member is detachably connected to said outer ridge such that said external cover member extend in parallel with said internal fabric member such as to provide a back/spine support associated with said stool seat member.

6. The baby seat carrier according to claim 1, wherein said stool seat member comprises a removable stool seat body arranged inside said stool seat member.

7. The baby seat carrier according to claim 1, further comprising side fasteners extending from said internal fabric member, said side fasteners being detachably attached to attachment points arranged on said external cover member such that the external cover member constitute back support associated with the suspended pocket seat or the stool seat member of the stool seat.

8. The baby seat carrier according to claim 1 wherein said internal fabric member is square or rectangular.

9. The baby seat carrier according to claim 1, wherein an external cover member lower end comprise an external cover zipper member, said internal fabric member comprise an internal fabric zipper member, said stool seat member comprise a stool seat zipper member, said external cover zipper member capable of engaging with said internal fabric zipper member and said stool seat zipper member.

10. The baby seat carrier according to claim 1, wherein a first and a second end of the extension member comprise a zipper member adapted to engaging with said internal fabric zipper member, the stool seat zipper member and/or the external cover zipper member.

11. The baby seat carrier according to claim 1, wherein the external cover member lower end comprises a first external cover zipper member and a second external cover zipper member.

12. The baby seat carrier according to claim 11, wherein the first external cover zipper member is adapted to engaging with the internal fabric zipper member and/or the zipper member of the second end of the extension member and the second external cover zipper member is adapted to engaging with the stool seat zipper member.

13. The baby seat carrier according to claim 11, wherein the length of the first external cover zipper member is shorter than the length of the second external cover zipper member.

14. The baby seat carrier according to claim 11, wherein the width of the external cover member lower end is arranged to be adapted to correspond to the length of the first and/or the second external cover zipper member.

15. The baby seat carrier according to claim 14, wherein the width of the external cover member lower end is arranged to be adapted by folding of the external cover member lower end.

16. The baby seat carrier according to claim 1 wherein an external cover member upper portion comprises a transverse (T) stitched pattern adapted to facilitate transverse (T) folding of said external cover member.

17. The baby seat carrier according to claim 1 wherein said external cover member comprise two stitched bow patterns each extending longitudinally in a bowed-shape from an edge of the external cover member upper portion to an edge of the external cover member lower portion such as to facilitate easy folding of said external cover member along said stitched arm seams.

18. The baby seat carrier according to claim 1 wherein said internal fabric member comprises more than one means for detachable attachment to said external cover member arranged at different lengths along the longitudinal direction (L) of said internal fabric member.

* * * * *